US006742623B2

(12) United States Patent
Tajima et al.

(10) Patent No.: US 6,742,623 B2
(45) Date of Patent: Jun. 1, 2004

(54) MUFFLER FOR INTERNAL COMBUSTION ENGINE

(75) Inventors: Katsuya Tajima, Okayama (JP); Sizuo Yamamiya, Tokyo (JP); Fujio Kobayashi, Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/254,819

(22) Filed: Sep. 25, 2002

(65) Prior Publication Data

US 2003/0062216 A1 Apr. 3, 2003

(30) Foreign Application Priority Data

Sep. 28, 2001 (JP) ..... 2001-302074

(51) Int. Cl.[7] ..... F01N 1/08

(52) U.S. Cl. ..... 181/269; 181/270; 181/266; 181/249; 181/250; 181/255

(58) Field of Search ..... 181/269, 270, 181/266, 249, 250, 251, 255, 264, 265

(56) References Cited

U.S. PATENT DOCUMENTS 3,887,032 A * 6/1975 Harris ..... 181/273
4,164,989 A * 8/1979 Lux et al. ..... 181/265
4,809,812 A * 3/1989 Flugger ..... 181/268
4,867,270 A * 9/1989 Wissmann et al. ..... 181/231

OTHER PUBLICATIONS

Japanese Utility Model Publication No. 5–44489 (1993) with English translation Abstract thereof.

* cited by examiner

*Primary Examiner*—Shih-Yung Hsieh
(74) *Attorney, Agent, or Firm*—Baker Botts LLP

(57) ABSTRACT

A muffler for an internal combustion engine is disclosed which is capable of effectively enhancing its muffling effect without any substantial increase in size, weight or manufacturing cost. The exhaust gas ejected from an exhaust port of the internal combustion engine is divided in the muffler into at least two flows. The divided exhaust gas flows are subsequently impinged against each other before the divided exhaust gas flows are finally discharged from a final exhaust port to the external atmosphere. More specifically, this muffler comprises an expansion chamber into which the exhaust gas is to be introduced from the exhaust port, and the expansion chamber is provided with at least two impingement openings for enabling the exhaust gas to be divided into at least two exhaust gas flows which are designed to be subsequently impinged against each other.

12 Claims, 4 Drawing Sheets

MUFFLER FOR INTERNAL COMBUSTION ENGINE

BACKGROUND OF THE INVENTION

1. Field of the Invention

This invention relates to a muffler for an internal combustion engine such as a small air-cooled two-stroke gasoline engine which is suited for use in a portable power working machine such as a brush cutter or a chain saw.

2. Description of the Related Art

Mufflers are known having a structure where its interior is provided with a large number of pipes and partition walls and, at the same time, a plurality of expansion chambers forming a multistage assembly. For example, Japanese Utility Model Publication H5-44489 describes a muffler having an inlet pipe defining a first chamber which communicates, via an inlet port formed in a main body of the muffler, with the exhaust port of the internal combustion engine, and with a partition plate placed inside the main body to define a second chamber and a third chamber. The first chamber communicates with the second and third chambers via holes differing in area from that of the inlet port at a predetermined ratio. The partition plate has a hole for communicating the second chamber with the third chamber, the area of the hole differing from that of the inlet port at a predetermined ratio. Either the second chamber or the third chamber has an outlet pipe communicating with the external atmosphere outside of the main body. The outlet pipe has a hole opened to the other one of the second chamber and the third chamber and has an area differing from that of the outlet pipe at a predetermined ratio, thus providing the muffler with a large number of pipes and partition walls and with a plurality of expansion chambers which form a multistage assembly.

Further, it is generally known that with a muffler for an internal combustion engine, the muffling effect can be enhanced by increasing the muffler's capacity (the capacity of the expansion chamber) or by increasing the number of expansion chambers to be formed into a multistage assembly. However, in the case of portable-type working machines in particular, it is impossible to spare so much space for installing the muffler, thus inevitably limiting the muffler's capacity. On the other hand, any increase in the number of pipes and partition walls would result in a structure of increased complexity as well as in increases of weight and manufacturing cost.

BRIEF SUMMARY OF THE INVENTION

This invention relates to the aforementioned circumstances, and therefore an object of the present invention is to provide a muffler for an internal combustion engine which is capable of effectively enhancing the muffling effect thereof without any substantial increase in size, weight and manufacturing cost.

With a view toward realizing the aforementioned object, a muffler for an internal combustion engine is provided according to this invention in which the exhaust gas ejected from the exhaust port of the internal combustion engine is divided into at least two flows, and the divided exhaust gas flows are subsequently impinged against each other before they are finally discharged from a final exhaust port to the external atmosphere.

According to a preferred embodiment of this invention, the muffler is provided with an expansion chamber into which the exhaust gas is to be introduced from the exhaust port, and the expansion chamber is provided with at least two openings for impingement (hereinafter, referred to as "impingement openings"), which enable the exhaust gas to be divided into at least two exhaust gas flows which are subsequently impinged against each other.

It is preferred that a collision chamber provided with the aforementioned final exhaust port is provided in a manner to cover the impingement openings.

Preferably, the expansion chamber comprises by a first expansion chamber into which exhaust gas is directly introduced from the exhaust port, and a second expansion chamber which is disposed next to and on the outer peripheral side of the first expansion chamber into which the exhaust gas is directly introduced via a blow-off port from the first expansion chamber. The second expansion chamber is provided with the impingement openings.

The first expansion chamber, the second expansion chamber and the collision chamber are preferably and by way of example defined by a metallic panel.

The aforementioned impingement openings preferably comprise louver-like openings (referred to herein as "louvered openings") which are symmetrically formed such that the directions of blow-off of the louvered openings are enabled to be intersected with each other.

In a further preferred embodiment of the muffler according to this invention, the collision chamber includes a plurality of final exhaust ports.

The first expansion chamber is formed of a rectangular tube provided with an exhaust gas inlet port wherein one sidewall is located on the side where the collision chamber is disposed and three other sidewalls are provided with the aforementioned blow-off port at a region located close to the aforementioned exhaust gas inlet port.

According to the aforementioned preferred embodiment of the muffler for an internal combustion engine according to the present invention, the exhaust gas that has been spouted from the exhaust port of the internal combustion engine is introduced, via the exhaust gas inlet port, into the first expansion chamber at nearly the acoustic velocity and is permitted to expand and diffuse therein, thereby enabling the exhaust sound to be attenuated. In this case, almost all of the exhaust gas that has been introduced into the first expansion chamber is impinged at first against the bottom of the first expansion chamber located facing the exhaust port and is then reflected therefrom. The reflected exhaust gas is ejected via the blow-off port into the second expansion chamber, thus permitting the reflected exhaust gas to expand and diffuse therein, thereby enabling the exhaust sound to be further attenuated.

The exhaust gas that has been expanded and diffused in the second expansion chamber is ejected, via the impingement openings attached to the second expansion chamber, into the collision chamber. At this point, the exhaust gas is divided into two exhaust gas flows, which are subsequently impinged against each other and then permitted to be discharged from the final exhaust ports attached to the collision chamber, thereby allowing the exhaust gas to be diffused into the external atmosphere.

As explained above, since the exhaust gas ejected out of the exhaust port is divided into at least two gas flows, and at the same time, since these exhaust gas flows are forced to impinge against each other before they are discharged into the external atmosphere from the final exhaust ports, it is possible to significantly attenuate the energy of the exhaust gas flow to be discharged into the external atmosphere. As a result, it is now possible to effectively enhance the muffling effect of the muffler without needing to increase the capacity of the muffler itself.

Furthermore, according to the muffler of the present invention, since the collision chamber functioning also as an expansion chamber is formed by making use of a panel, without employing a large number of pipes and partitioning walls, and at the same time, since the impingement openings and final exhaust ports are formed in this panel defining the expansion chambers, the number of parts can be reduced. Moreover, the structure of the muffler can be simplified, thus resulting in the reduction of weight and manufacturing cost.

BRIEF DESCRIPTION OF THE SEVERAL VIEWS OF THE DRAWING

Further objects and advantages of the invention will be apparent from a reading of the following description in conjunction with the accompanying drawings in which.

DETAILED DESCRIPTION OF THE INVENTION

Figure 1:
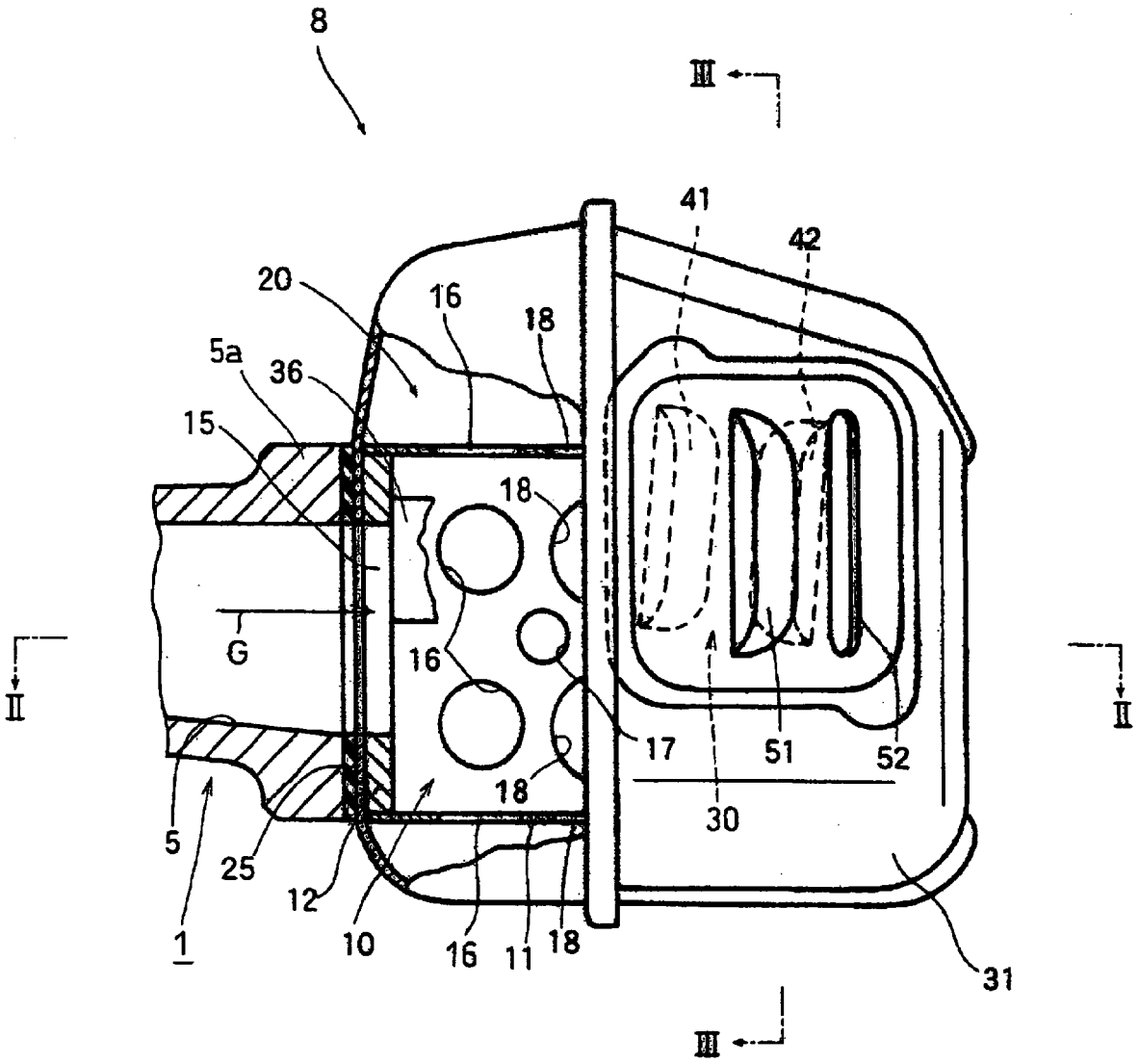
FIG. 1 is a partially cut side view of a muffler representing one embodiment of the present invention.
Figure 2:
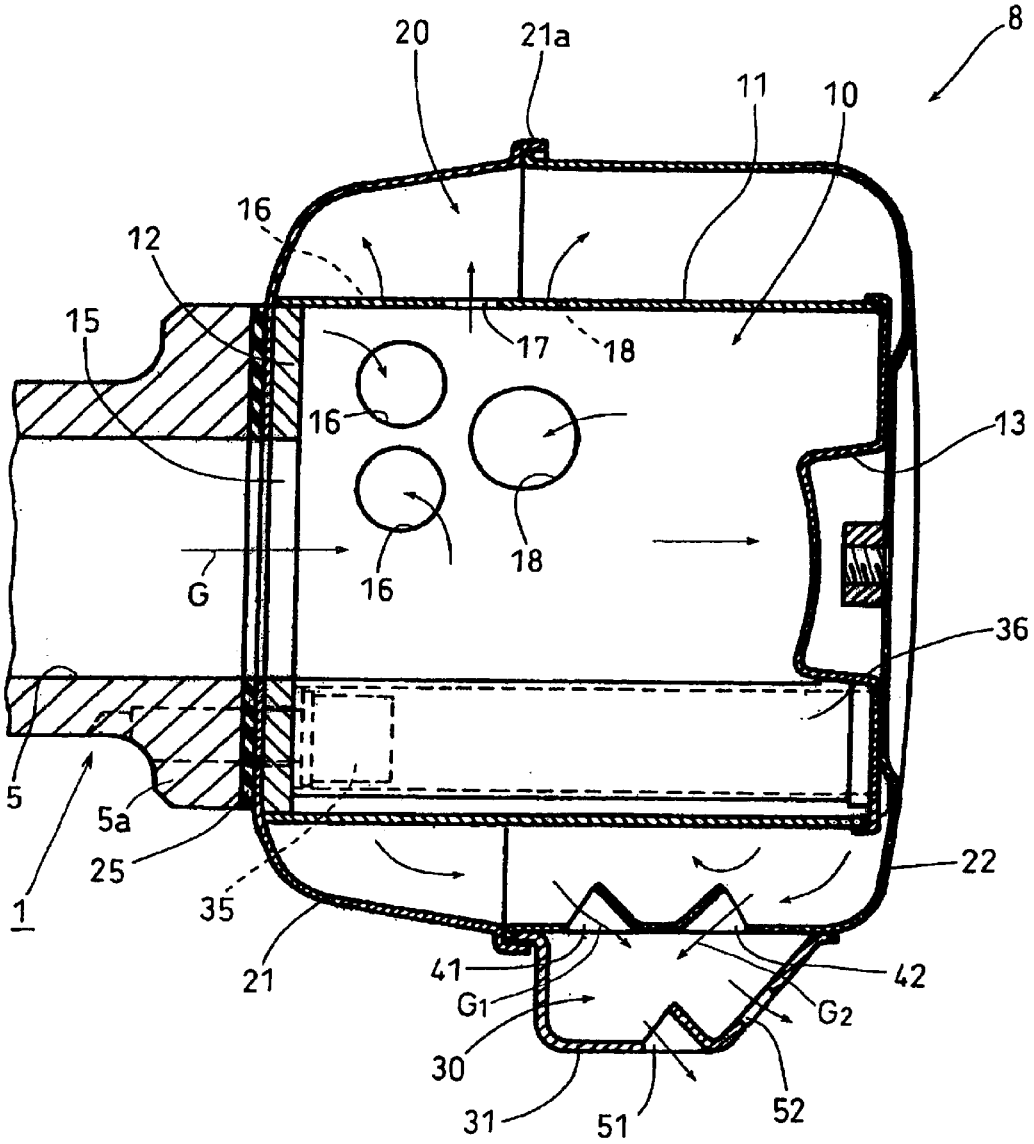
FIG. 2 is a cross-sectional view taken along the line II—II of FIG. 1.
Figure 3:
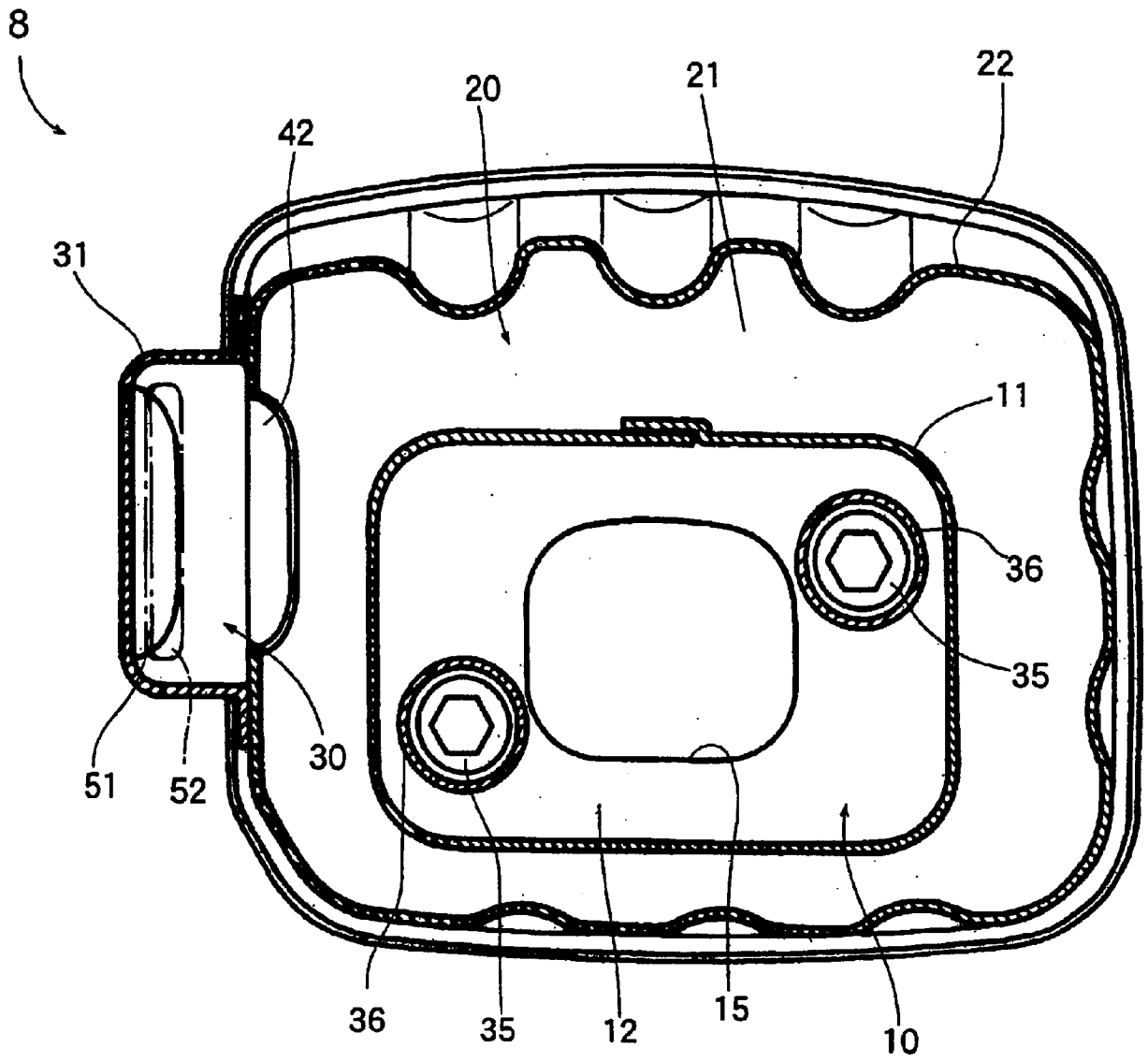
FIG. 3 is a cross-sectional view taken along the line III—III of FIG. 1.
Figure 4:
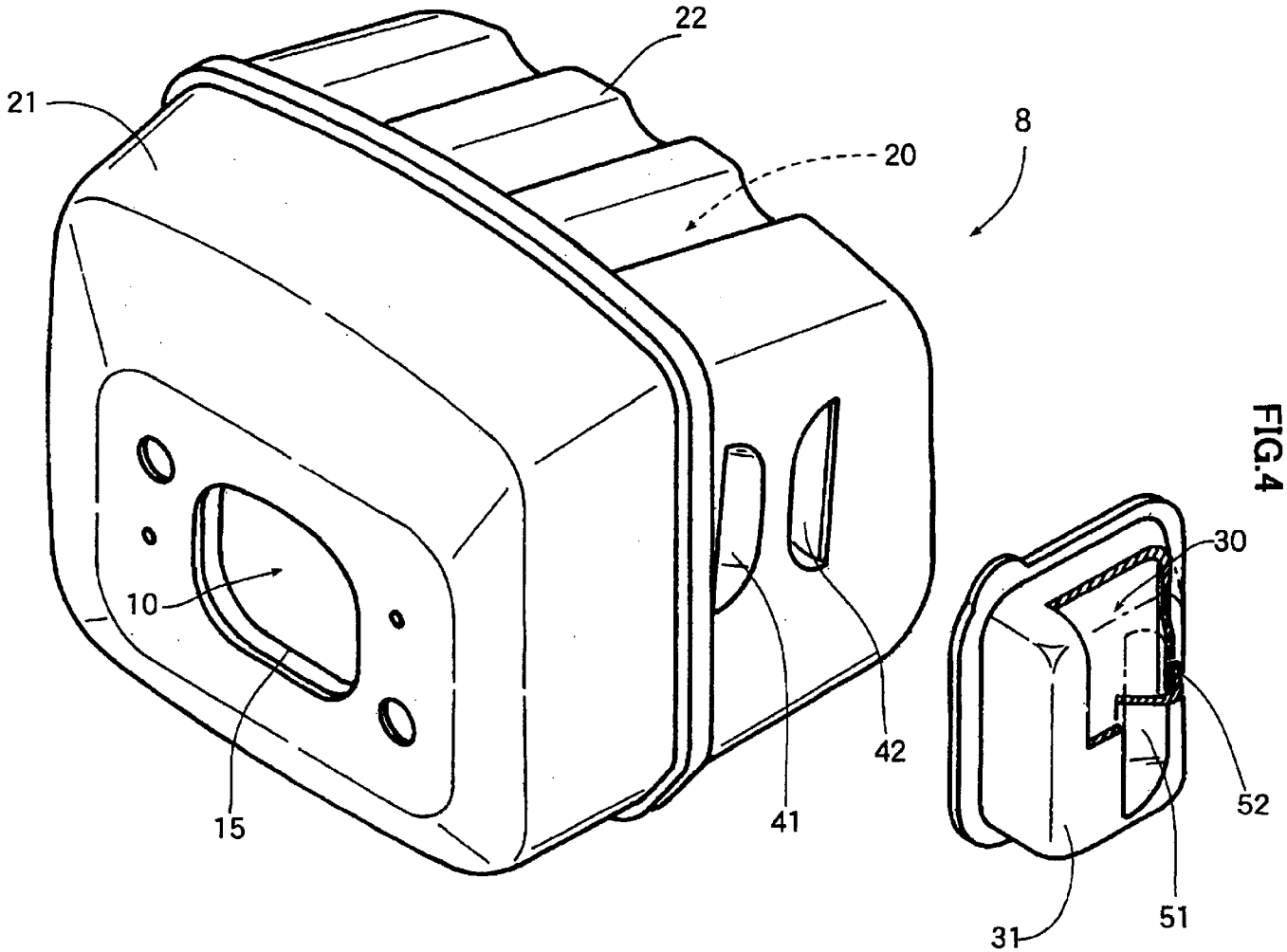
FIG. 4 is a partially exploded perspective view of the muffler shown in FIG. 1.

Referring to FIGS. 1–4, a muffler 8 is designed to be employed in the exhaust system of a small air-cooled two-stroke gasoline engine (hereinafter, referred to as an "internal combustion engine") 1 to be employed in a portable working machine such as a brush cutter or a chain saw. This muffler 8 comprises a first expansion chamber 10 having a bottomed rectangular configuration, into which exhaust gas G is directly introduced from the exhaust port 5 of the internal combustion engine 1, a second expansion chamber 20 which is disposed next to and on the outer peripheral side of the first expansion chamber 10, and a collision chamber 30 which is relatively small in capacity and disposed on one external peripheral sidewall of the second expansion chamber 20. The first expansion chamber 10 is defined by an inner wall panel 11 which is bent or formed into a rectangular tube having rounded corners, an inlet port-reinforcing plate 12 which is fixed to the front-end portion of the inner wall panel 11 and provided with an exhaust gas inlet port 15 for permitting exhaust gas to be introduced therein from the exhaust port 5, and a bottom wall panel 13 which is formed into a U-shaped configuration in cross-section and fixed to the rear-end portion of the inner wall panel 11.

The inner wall panel 11 constituting the first expansion chamber 10 is constructed such that three sidewalls thereof, at a region located close to the exhaust gas inlet port 15, are provided with a suitable number of blow-off ports 16, 17 and 18 for introducing the exhaust gas G into the second expansion chamber 20. The three sidewalls do not include the one sidewall which is located on the side where the collision chamber 30 is disposed. More specifically, one sidewall of the inner wall panel 11 which is located opposite to the sidewall where the collision chamber 30 is disposed is provided with a couple of lower and upper medium blow-off ports 16 which are located close to the exhaust gas inlet port 15, with a couple of lower and upper large blow-off ports 18 which are juxtaposed with the medium blow-off ports 16, and with a small blow-off port 17 which is disposed in the middle of these blow-off ports 16 and 18. Likewise, the other two sidewalls are also provided with one large blow-off port 18 and a couple of lower and upper medium blow-off ports 16, all of which are located close to a region of the first mentioned one sidewall where the blow-off ports 16, 17 and 18 are provided, thus aiding in making the flowing route of the exhaust gas G as long as possible.

The second expansion chamber 20 is defined by a front-side external wall panel 21 which is formed into a tray-like configuration and located neighboring the exhaust port 5, and a rear-side external wall panel 22 which is formed into a vessel-like configuration and fixed, by means of welding for example, to the rear-end portion 21*a* of the front-side external wall panel 21. This second expansion chamber 20 is provided, on one peripheral sidewall of the rear-side external wall panel 22, i.e., the sidewall neighboring the collision chamber 30, with a couple of impingement openings 41 and 42 for enabling the exhaust gas G to be divided into at least two gas flows G1 and G2, and at the same time, enabling these gas flows G1 and G2 to be impinged against each other. This couple of impingement openings 41 and 42 are louver-like openings which are symmetrically formed such that the directions of blow-off are enabled to be intersected with each other at a suitable angle (about 90 degrees for instance).

The collision chamber 30 is defined by a covering panel 31 which is trapezoidal in cross-section and fixed, by means of welding for example, to the rear-side external wall panel 22 so as to cover the aforementioned impingement openings 41 and 42 which are provided on one peripheral sidewall of the second expansion chamber 20. This covering panel 31 is provided with a couple of final exhaust ports 51 and 52 which are formed parallel with each other. In order to provide the exhaust gas G with a desired directivity in the discharging direction thereof, one of the final exhaust ports (for example, the final exhaust port 51) is formed into a louver-like opening, while the other final exhaust port 52 for instance is formed into a simple rectangular opening.

The inner wall panel 11, the bottom wall panel 13, the external wall panels 21 and 22, and the covering panel 31 are formed of a metallic thin plate such as a heat resistant steel, which is molded into a predetermined configuration by means of press working. The aforementioned louver-like impingement openings 41 and 42, and the final exhaust ports 51 and 52 can be formed simultaneously with the press-molding of the aforementioned panels.

Further, the aforementioned first expansion chamber 10 and second expansion chamber 20 are secured to the exhaust port 5 by making use of hexagon socket head cap screws 35 which have been pierced through the inlet port-reinforcing plate 12, the front-side external wall panel 21 and a heat-insulating plate 25. The hexagon socket head cap screws 35 are introduced, through a couple of guide pipes 36 which are fixed to the inlet port-reinforcing plate 12 and extended across the first expansion chamber 10 and the second expansion chamber 20, into the muffler from the outside of the rear-side external wall panel 22 toward the exhaust port 5 and screwed on mounting flanges 5*a* integrally formed around the exhaust port 5.

According to the muffler 8 which is constructed as described in this embodiment, the exhaust gas G that has been spouted from the exhaust port 5 of the internal combustion engine 1 is introduced, via the exhaust gas inlet port 15, into the first expansion chamber 10 at nearly the acoustic velocity and is permitted to expand and diffuse therein, thereby enabling the exhaust sound to be attenuated. In this case, almost all of the exhaust gas G that has been introduced into the first expansion chamber 10 is impinged at first against the bottom (bottom wall panel 13) of the first expansion chamber 10 located facing the exhaust port 5 and is then reflected therefrom. The reflected exhaust gas G is ejected via the blow-off ports 16, 17 and 18 into the second expansion chamber 20, thus permitting the reflected exhaust gas to expand and diffuse therein, thereby enabling the exhaust sound to be further attenuated.

The exhaust gas G that has been expanded and diffused in the second expansion chamber 20 is ejected, via the impingement openings 41 and 42 attached to the second expansion chamber 20, into the collision chamber 30. At this point, the exhaust gas is divided into two exhaust gas flows G1 and G2, which are subsequently impinged against each other and then permitted to be discharged from the final exhaust ports 51 and 52 attached to the collision chamber 30 so as to be discharged outside and diffused into the air atmosphere.

As explained above, since the exhaust gas G that has been ejected out of the exhaust port 5 of internal combustion engine 1 is divided into at least two gas flows G1 and G2, and at the same time, since these exhaust gas flows G1 and G2 are forced to impinge against each other before they are discharged into the external atmosphere from the final exhaust ports 51 and 52, it is possible to significantly attenuate the energy of the exhaust gas flow to be discharged into the external atmosphere. As a result, it is now possible to effectively enhance the muffling effect of the muffler without needing to increase the capacity of the muffler itself.

According to the muffler of this embodiment, since the collision chamber 30, functioning also as an expansion chamber, is formed by making use of the panel 31 without employing a large number of pipes and partitioning walls, and at the same time, the impingement openings 41 and 42 and the final exhaust ports 51 and 52 are formed in the panels 22 and 31 defining the expansion chambers, the number of parts can be reduced, and at the same time, the structure of the muffler 8 can be simplified, thus resulting in the reduction of weight and manufacturing cost.

While in the foregoing one embodiment of this invention has been explained in detail for the purpose of illustration, it will be understood that the construction of the device can be varied without departing from the spirit and scope of the invention.

For example, the muffler according to this invention can be applied not only to the air-cooled two-stroke gasoline engine illustrated in the aforementioned embodiment, but also to a four-stroke engine.

What is claimed is:

1. A muffler for an internal combustion engine having an exhaust port, the muffler comprising:

an expansion chamber into which exhaust gas is to be introduced from the exhaust port of the internal combustion engine, the expansion chamber having at least two impingement openings for enabling the exhaust gas to be divided into at least two exhaust gas flows and enabling the divided exhaust gas flows to be subsequently impinged against each other, wherein the expansion chamber comprises a first expansion chamber into which the exhaust gas is directly introduced from the exhaust port, and a second expansion chamber which is disposed next to and on the outer peripheral side of the first expansion chamber into which the exhaust gas is directly introduced via at least one blow-off port from the first expansion chamber, the second expansion chamber being provided with the impingement openings;

a final exhaust port for discharging the exhaust gas flows to the external atmosphere; and a collision chamber which includes the final exhaust port and covers the impingement openings.

2. The muffler according to claim 1, wherein the first expansion chamber, the second expansion chamber and the collision chamber are defined by at least one metallic panel.

3. The muffler according to claim 2, wherein the impingement openings comprise louvered openings symmetrically formed such that the directions of exhaust gas flow from the louvered openings are enabled to be intersected with each other.

4. The muffler according to claim 3, wherein the collision chamber is provided with a plurality of final exhaust ports.

5. The muffler according to claim 4, wherein the first expansion chamber is formed of a rectangular tube provided with an exhaust gas inlet port and includes four sidewalls, the first sidewall located on the side where the collision chamber is disposed and the three other sidewalls include the at least one blow-off port at a region of the first expansion chamber located close to the exhaust gas inlet port.

6. The muffler according to claim 1, wherein the first expansion chamber is formed of a rectangular tube provided with an exhaust gas inlet port and includes four sidewalls, the first sidewall located on the side where the collision chamber is disposed and the three other sidewalls include the at least one blow-off port at a region of the first expansion chamber located close to the exhaust gas inlet port.

7. The muffler according to claim 1, wherein the first expansion chamber is formed of a rectangular tube provided with an exhaust gas inlet port and includes four sidewalls, the first sidewall located on the side where the collision chamber is disposed and the three other sidewalls include the at least one blow-off port at a region of the first expansion chamber located close to the exhaust gas inlet port.

8. A muffler for an internal combustion engine having an exhaust port, the muffler comprising:

an expansion chamber into which exhaust gas is to be introduced from the exhaust port of the internal combustion engine, the expansion chamber having at least two impingement openings for enabling the exhaust gas to be divided into at least two exhaust gas flows and enabling the divided exhaust gas flows to be subsequently impinged against each other, wherein the expansion chamber comprises a first expansion chamber into which the exhaust gas is directly introduced from the exhaust port, and a second expansion chamber which is disposed next to and on the outer peripheral side of the first expansion chamber into which the exhaust gas is directly introduced via at least one blow-off port from the first expansion chamber, the second expansion chamber being provided with the impingement openings; and a final exhaust port for discharging the exhaust gas flows to the external atmosphere.

9. The muffler according to claim 8, wherein the impingement openings comprise louvered openings symmetrically formed such that the directions of exhaust gas flow from the louvered openings are enabled to be intersected with each other.

10. The muffler according to claim 9, wherein a collision chamber is provided with a plurality of final exhaust ports.

11. The muffler according to claim 10, wherein the first expansion chamber is formed of a rectangular tube provided with an exhaust gas inlet port and includes four sidewalls, the first sidewall located on the side where the collision chamber is disposed and the three other sidewalls include the at least one blow-off port at a region of the first expansion chamber located close to the exhaust gas inlet port.

12. The muffler according to claim 8, wherein the first expansion chamber is formed of a rectangular tube provided with an exhaust gas inlet port and includes four sidewalls, the first sidewall located on the side where a collision chamber is disposed and the three other sidewalls include the at least one blow-off port at a region of the first expansion chamber located close to the exhaust gas inlet port.

* * * * *